US011016420B2

(12) United States Patent
Sabo et al.

(10) Patent No.: US 11,016,420 B2
(45) Date of Patent: May 25, 2021

(54) INHIBITING INK FLOW STREAKS

(71) Applicant: HEWLETT-PACKARD DEVELOPMENT COMPANY, L.P., Spring, TX (US)

(72) Inventors: David Sabo, San Diego, CA (US); Blair A. Butler, San Diego, CA (US); Jeffrey Zampell, San Diego, CA (US); Avinoam Halpern, San Diego, CA (US); Sarah Ann Russell, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/604,340

(22) PCT Filed: Dec. 15, 2017

(86) PCT No.: PCT/US2017/066579
§ 371 (c)(1),
(2) Date: Oct. 10, 2019

(87) PCT Pub. No.: WO2019/117935
PCT Pub. Date: Jun. 20, 2019

(65) Prior Publication Data

US 2020/0301316 A1 Sep. 24, 2020

(51) Int. Cl.
*G03G 15/11* (2006.01)

(52) U.S. Cl.
CPC ..... *G03G 15/11* (2013.01); *G03G 2215/0658* (2013.01)

(58) Field of Classification Search
CPC ..... G03G 15/11; G03G 2215/0658; G03G 15/104
See application file for complete search history.

(56) References Cited

U.S. PATENT DOCUMENTS

| | | | |
|---|---|---|---|
| 4,286,039 | A | 8/1981 | Landa et al. |
| 5,893,663 | A | 4/1999 | Facci et al. |
| 7,356,287 | B2 | 4/2008 | Guzman et al. |
| 7,522,865 | B2 | 4/2009 | Hasdai et al. |
| 7,657,209 | B2 | 2/2010 | Sabo et al. |
| 8,837,990 | B2 | 9/2014 | Nelson et al. |
| 2004/0183883 | A1 | 9/2004 | Suzuki et al. |
| 2010/0215405 | A1 | 8/2010 | Patton et al. |

(Continued)

FOREIGN PATENT DOCUMENTS

| | | |
|---|---|---|
| EP | 2193405 | 6/2010 |
| JP | H10274885 A | 10/1998 |

(Continued)

*Primary Examiner* — Sandra Brase
(74) *Attorney, Agent, or Firm* — Trop Pruner & Hu PC

(57) ABSTRACT

A technique includes rotating a squeegee roller to regulate a film thickness of ink on a developer roller; and using the developer roller to transfer a portion of the ink from the developer roller to a photoconductive member. The technique includes creating, by an electrode, a potential bias with the developer roller to transfer the ink to the developer roller; and inhibiting flow streaks on the developer roller, where inhibiting the flow streaks includes restricting a flow of ink between the squeegee roller and the electrode.

15 Claims, 7 Drawing Sheets

(56) References Cited

U.S. PATENT DOCUMENTS

| | | | | |
|---|---|---|---|---|
| 2011/0074894 | A1* | 3/2011 | Sabo | B41J 2/0057 347/92 |
| 2011/0249989 | A1 | 10/2011 | Levintant et al. | |
| 2012/0195644 | A1 | 8/2012 | Nelson et al. | |
| 2013/0011162 | A1 | 1/2013 | Nelson et al. | |

FOREIGN PATENT DOCUMENTS

| | | | |
|---|---|---|---|
| WO | WO-2011025508 | A1 | 3/2011 |
| WO | WO2016114757 | A1 | 7/2016 |
| WO | WO2017119905 | A1 | 7/2017 |

* cited by examiner

INHIBITING INK FLOW STREAKS

BACKGROUND

Printing systems, such as liquid electro photographic (LEP) printers, include binary ink developer (BID) assemblies. In general, the BID assembly transfers a thin layer of ink to a photoconductive member of the printing system. Moreover, the printing system may have multiple BID assemblies, where each BID assembly is associated with a particular ink color.

DETAILED DESCRIPTION

Figure 1:
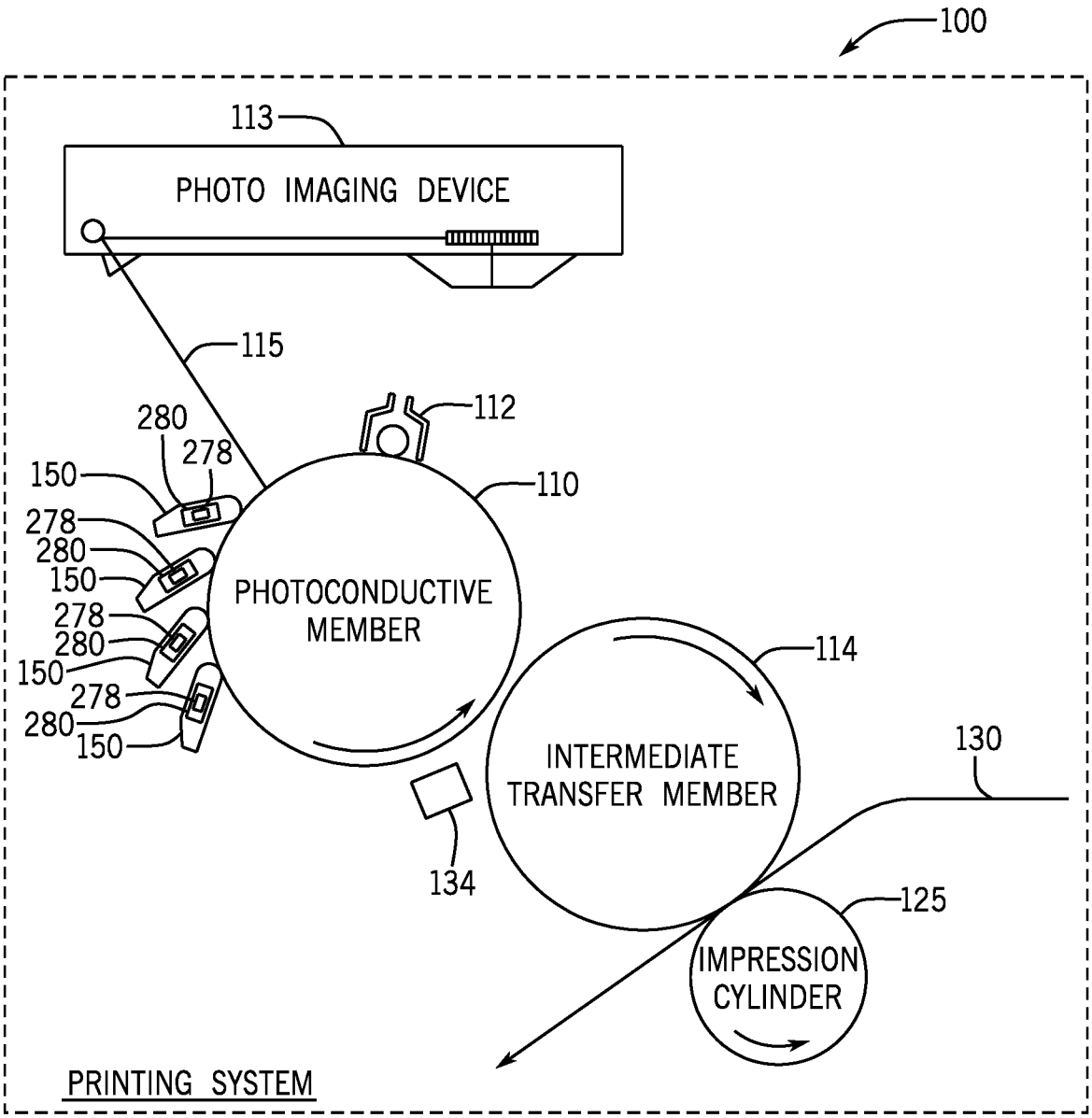
FIG. 1 is a schematic diagram of a printing system according to an example implementation.

Printing systems, such as liquid electro photographic (LEP) printers, may include binary ink developer (BID) assemblies. In the context of this application, an "ink developer assembly" refers to an arrangement of components, which transfers ink (liquid toner) from an ink reservoir to a photoconductive member (external to the ink developer assembly) of the printing system. For this purpose, the ink developer system may contain a developer roller on which the ink developer system forms a relatively thin layer, or film, of ink. In general, the developer roller rotates and contacts the photoconductive member to transfer ink from the developer roller to the photoconductive member. A BID assembly contains ink of a single color and may be used with other BID assemblies (associated with other ink colors) to transfer inks of multiple colors to the photoconductive member.

For each ink color, the photo imaging device (laser, for example) of the printing system may pattern the photoconductive member with an electrostatic image that corresponds to an image to be printed. The transfer of ink onto the photoconductive member forms a toner image, and the printing system transfers the toner image from the photoconductive member to a print medium.

In addition to the developer roller, the BID assembly may include electrodes that create a potential bias with respective to the developer roller for purposes of creating an electric field to transfer the ink to the developer roller; and the BID assembly may include a squeegee roller that may, for example, rotate in proximity to the developer roller to regulate a thickness of the ink film on the developer roller.

The process of forming the ink film on the developer roller may produce a printing defect called "ink flow streaks" or "flow streaks" herein. In this context, "ink flow streaks" refers to an uneven distribution of ink on the developer roller (i.e., the ink film does not have a uniform thickness) so that corresponding unintended streaks may be formed on the developer roller; and consequently, corresponding streaks of ink may be transferred onto the print medium. Moreover, ink flow streaks may become more pronounced with high printing process speeds.

In accordance with example implementations that are described herein, a BID assembly inhibits ink flow streaks by restricting the flow of ink in an ink flow path of the BID assembly. More specifically, in accordance with example implementations, the BID assembly includes an ink flow path to deliver ink from an ink reservoir to the BID assembly to a developer roller of the BID assembly. Due to the process in which ink is transferred to the developer roller, some of the delivered ink is not transferred to the developer roller. The ink flow path therefore includes a return channel to communicate the ink that was not transferred to the developer roller back to the ink reservoir. In accordance with example implementations, the return channel contains a flow restriction to inhibit ink flow streaks.

In accordance with example implementations, the ink flow path contains an ink delivery channel, which extends around a main electrode and a secondary, or back, electrode of the BID assembly. The main and back electrodes may be set to the same voltage, or potential, so that a potential bias (i.e., a voltage) is created between the electrodes and the developer roller to create an electric field to transfer ink onto the developer roller. The return channel of the ink flow path receives the ink that was not transferred to the developer roller, and the return channel may be routed, or extend between, a squeegee roller of the BID assembly and the main electrode. The return channel guides the returning ink to an ink collection tray of the BID assembly, which drains into the ink reservoir.

In accordance with example implementations, the ink flow streak-inhibiting flow restriction may be formed between the main electrode and the squeegee roller by an electrically nonconductive, or dielectric, member (a planar plastic member, for example), which is attached to the main electrode. In this manner, in accordance with example implementations, the flow restriction corresponds to a gap between the outer surface of the dielectric member and the outer curved surface of the squeegee roller.

The gap may be within in a range that is small enough to inhibit the formation of ink flow streaks, while at the same time is not too small, which may result in one or multiple other print defects. In this manner, if the gap is too small, there may be an insufficient flow of solid ink particles to the developer roller, which may result in optical density criteria not being met. In accordance with example implementations, the gap is in the range of 0.8 millimeters (mm) to 1.2 mm.

In the context of this application, "ink" refers to a mixture, such as liquid toner, which contains solid ink particles and fluid. The fluid may be, as examples, a base liquid (an oil base, for example), or a mixture of a base liquid and air.

In accordance with example implementations, the ink that is delivered to the developer roller through the delivery channel of the ink flow path may be more dense than the ink that returns through the return channel of the ink flow path.

For example, in accordance with some implementations, the ink provided to the developer roller through the delivery channel of the ink flow path may contain a concentration of solid ink particles of approximately three percent (as an example), whereas the ink returning through the return channel of the ink flow path may contain a lower concentration of solid ink particles, such as a concentration of approximately 1.5 percent (as an example). It has been discovered that by restricting the flow of ink in the return channel of the ink flow path in the appropriate manner, flow streak development on the developer roller may be inhibited, if not prevented.

As a more specific example, FIG. 1 depicts a printing system 100 in accordance with some implementations. As an example, the printing system 100 may be a liquid electro photographic (LEP) printer. In general, the printing system 100 includes one or multiple BID assemblies 150; a photoconductive member 110; a charging device 112; a photo imaging device 113; an intermediate transfer member 114; an impression cylinder 125; and a discharging device 134. As depicted in FIG. 1, the BID assemblies 150 may be located adjacent to the photoconductive member 110 (each BID assembly 150 may contact the photoconductive member 110, for example) for purposes of transferring ink to the photoconductive member 110. The BID assemblies 150 correspond to various ink colors, such as cyan, magenta, yellow, black, and so forth (and may correspond to other and/or different ink colors); and each BID assembly 150 transfers ink of its associated ink color to the photoconductive member 110 to form a corresponding toner image on the photoconductive member 110 corresponding to the associated ink color.

The BID assembly 150, in general, includes various components to control the transfer of ink to the photoconductive member 110 in a manner that inhibits the formation of ink flow streaks. In accordance with example implementations, the BID assembly 150 includes, among its other components, a squeegee roller 230 and an electrically non-conductive, or dielectric, member 278. The dielectric member 278 is positioned, as described herein, to create an ink flow restriction between the dielectric member 278 and the outer curved surface of the squeegee roller 230 to inhibit, if not prevent, the formation of ink flow streaks.

As described herein, the dielectric member 278 may take on such forms as a plate, or sheet (a plastic plate or sheet, as examples); or the dielectric member 278 may be (as another example) a splash guard for the squeegee roller 230. Regardless of its particular form, the dielectric member 278 may be mounted to a main electrode of the BID assembly 150 (as described herein) for purposes of restricting the flow of ink between the main electrode and the outer curved surface of the squeegee roller 230 in manner that inhibits, if not prevents, the formation of ink flow streaks on a developer roller of the BID assembly 150, without introducing any additional print defects.

In accordance with example implementations, the photoconductive member 110, the intermediate transfer member 114 and the impression cylinder 125 may rotate, as depicted in FIG. 1. The charging device 112 applies a uniform electrostatic charge to an outer photoconductive surface of the photoconductive member 110. The photo imaging device 113 (a device containing a laser, for example) exposes selected areas of the photoconductive surface of the photoconductive member 110 to light in a pattern of a particular printed image to dissipate charge on the selected areas that are exposed to the light to form a latent electrostatic image on the photoconductive member 110. In accordance with example implementations, the photoconductive member 110 forms multiple such latent electrostatic images on the photoconductive member 110 for each revolution of the photoconductive member 110, which correspond to the different ink colors. The ink transferred from each BID assemblies 150 adhere to its corresponding latent electrostatic image to form a corresponding toner image associated with a particular ink color.

The toner images are transferred from the photoconductive member 110 to the intermediate transfer member 114 and transferred from the intermediate transfer member 114 to the print medium 130, as the print medium 130 passes through an impression nip that is formed between the intermediate transfer member 114 and the impression cylinder 125. The discharging device 134 removes residual charge from the photoconductive member 110.

Figure 2:
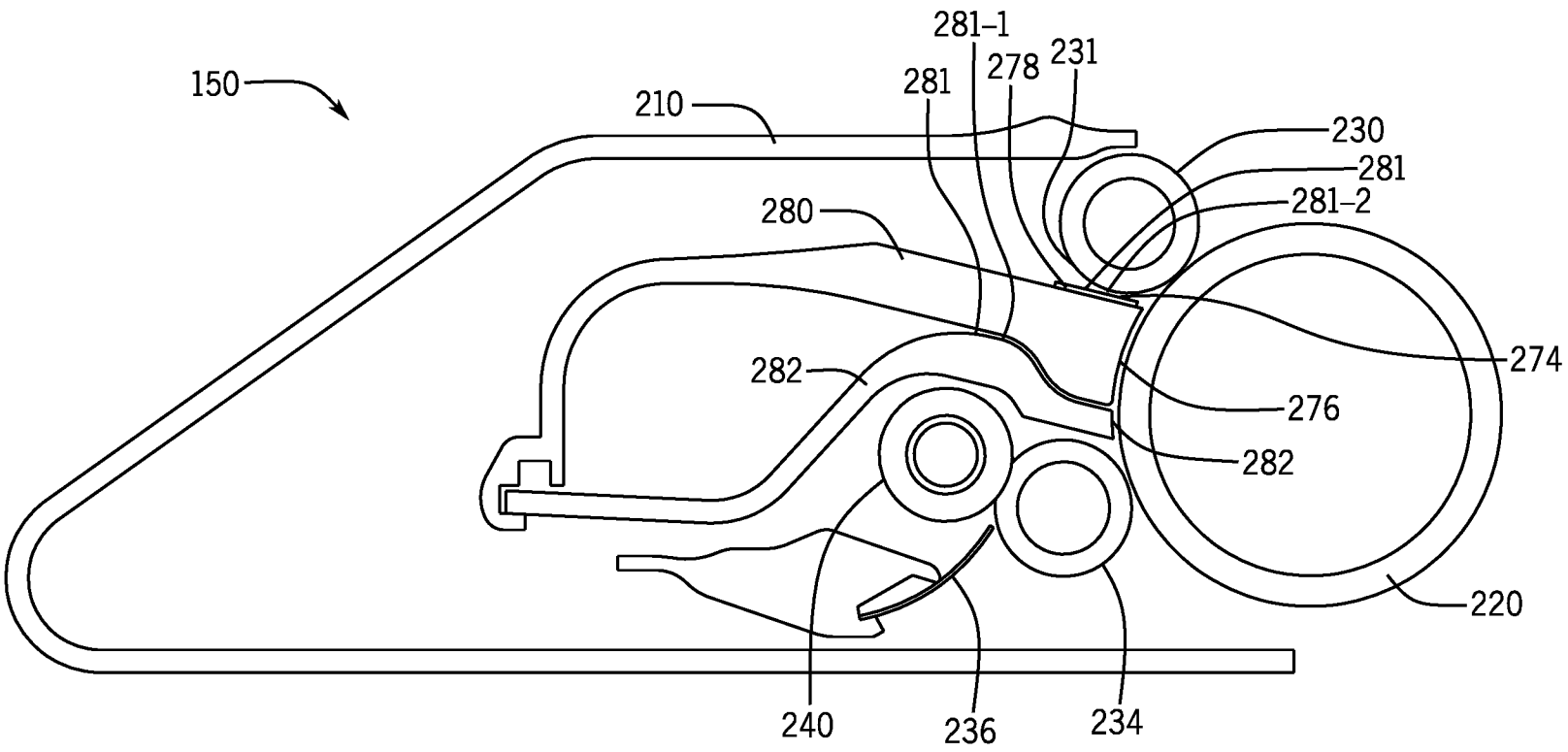
FIG. 2 is a schematic diagram of a binary ink developer (BID) assembly according to an example implementation.

FIG. 2 is a schematic diagram of the BID assembly 150, in accordance with example implementations. The BID assembly 150 includes an outer housing 210, a developer roller 220, a squeegee roller 230, a main electrode 280, and a back electrode 282. For purposes of transferring ink to the developer roller 220, the BID assembly 150 includes an ink flow path 281, which includes an ink delivery channel 281-1 and an ink return channel 281-2. As depicted in FIG. 2, the ink delivery channel 281-1 extends between the lower surface (for the orientation depicted in FIG. 2) of the main electrode 280 and the upper surface of the back electrode 282; and, in general, the ink delivery channel 281-1 is part of the ink flow path that communicates ink from an ink reservoir (an ink reservoir external to the BID assembly 150, for example) to the developer roller 220. Ink that is not transferred to the developer roller 220 returns through the return channel 281-2, which, as depicted in FIG. 2, extends between the outer curved surface 231 of the squeegee roller 230 and the upper surface (for the orientation depicted in FIG. 2) of the main electrode 280.

In accordance with some implementations, the dielectric member 278 forms a flow restriction in the return channel 281-2 of the ink flow path 281. For the specific example of FIG. 2, the dielectric member 278 is a planar plate, or sheet, which is attached to the upper surface of the main electrode 280.

The housing 210, in general, may form an outer enclosure for the components of the BID assembly 150 and may, in general, provide a support, or chassis for purposes of mounting the components (the squeegee roller 230, the main electrode 280, the developer roller 220, and so forth) of the BID assembly 150 thereon. The developer roller 220 receives ink from the delivery channel 281-1 and transfers a portion of the ink to the photoconductive member 110 (See FIG. 1) of the printing system 100.

The main electrode 280 of the BID assembly 150 includes a curved surface 276, which corresponds to the curved outer surface of the developer roller 220. In general, the main electrode 280 has a voltage, or potential, which is set relative to a potential formed on the developer roller 220 to form a potential bias between the main electrode 280 and the developer roller 220. Moreover, in accordance with example implementations, the back electrode 282 is set to the same voltage of the main electrode 280. This potential bias, in turn, forms an electric field to transfer ink to the outer surface of the developer roller 220. The squeegee roller 230 regulates a thickness of the ink film formed on the developer roller 220, and the squeegee roller 230 also is held at a voltage, which pushes ink towards the developer roller 220.

The pushing of ink toward the developer roller serves to compact the ink layer as well as regulate the ink film thickness.

Figure 3:
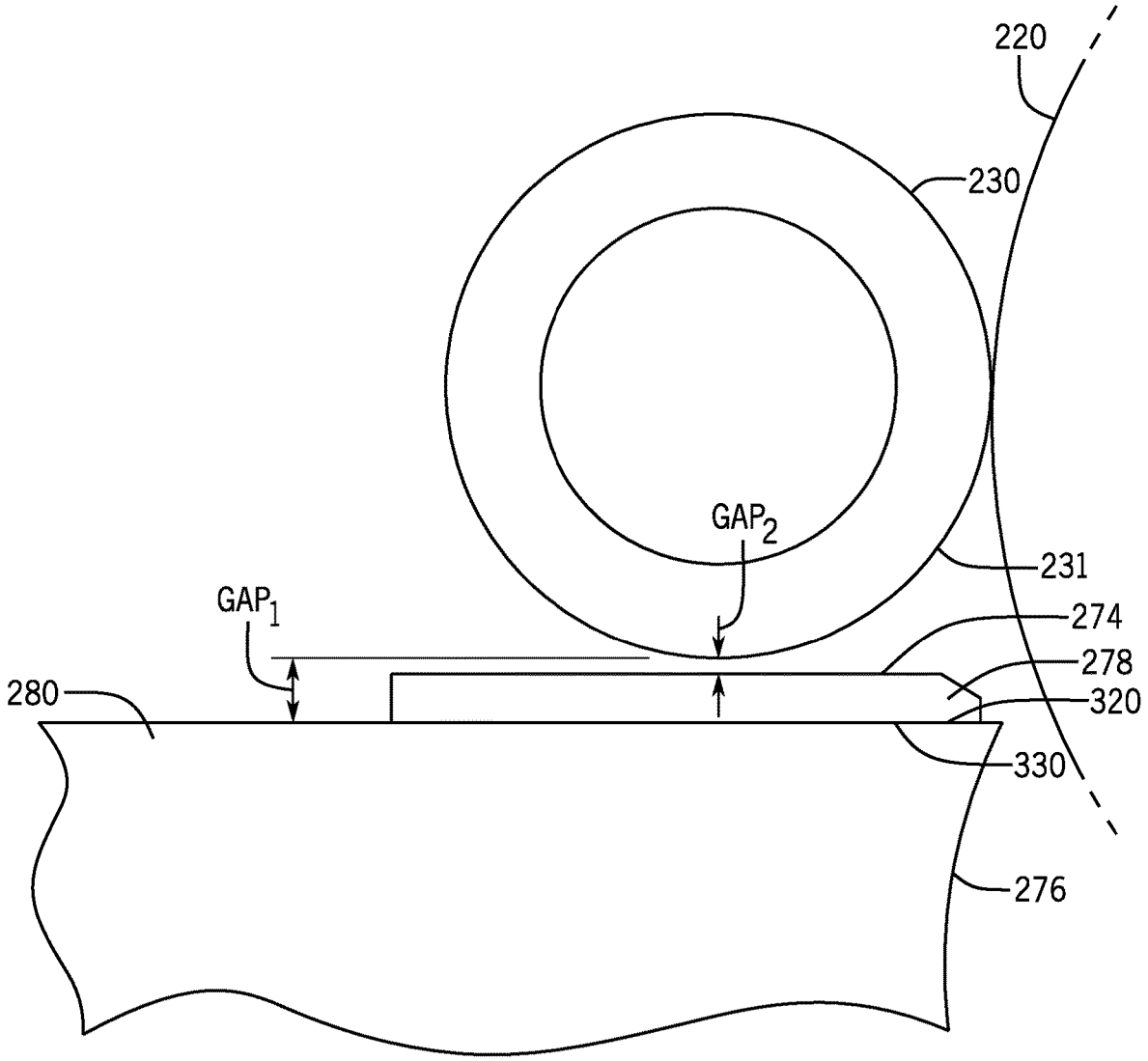
FIG. 3 is a schematic diagram of a portion of the BID assembly of FIG. 2 illustrating an ink flow restriction formed between a squeegee roller and a main electrode assembly of the BID assembly according to an example implementation.

More specifically, referring to FIG. 3 in conjunction with FIG. 2, the flow restriction in the return channel 281-2 of the ink flow path 281 may be formed as follows. In accordance with some implementations, the dielectric member 278 is mounted against the main electrode 280. A distance, or gap (called "$Gap_1$" in FIG. 3), exists between the outer curved surface 231 of the squeegee roller 230 and the upper surface 320 of the main electrode 280. The squeegee roller 230 may be connected to a voltage that is different from the voltage of the main electrode 280; and $Gap_1$ gap ensures that the distance between the main electrode 280 and the squeegee roller is sufficient so that the electric field that exists between the squeegee roller 230 and the main electrode 280 does not break down. The dielectric member 278, as illustrated in FIG. 3, may be planar, and a lower surface 330 surface of the dielectric member 278 may be adhered to an upper outer surface 320 of the main electrode 280.

More specifically, in accordance with some implementations, the dielectric member 278 may be a plastic sheet, which has a corresponding thickness to establish a particular gap (called "$Gap_2$" in FIG. 3) between the upper surface 274 of the dielectric member 278 and the outer curved surface 231 of the squeegee roller 230. The $Gap_2$ gap, in accordance with example implementations, corresponds to the flow restriction, which inhibits the formation of ink flow streaks on the developer roller 220.

In accordance with some implementations, an intervening adhesive layer (not depicted in FIG. 3) may bond the mating surfaces 320 and 330 the dielectric member 278 to the main electrode 280. In accordance with some implementations, the $Gap_2$ gap may be less than 1.2 mm. More specifically, in accordance with some implementations, the $Gap_2$ gap may be in the range of 0.8 mm to 1.2 mm.

Thus, in accordance with example implementations, the main electrode 280 and the dielectric member 278 form an electrode assembly to create a potential bias with the developer roller 220 to transfer ink to the developer roller 220 and create a gap between the squeegee roller 230 and the electrode assembly. The gap corresponds to a flow restriction to the ink flow to inhibit the formation of flow streaks on the developer roller 220 (and ultimately, on the print medium).

Referring back to FIG. 2, among its other features, in accordance with some implementations, the BID assembly 150 may include a cleaner roller 234, which is disposed between and in contact with the outer surface of the developer roller 220. Moreover, as depicted in FIG. 2, the cleaner roller 234 may be cleaned by a wiper 236. In this manner, the cleaner roller 234, in accordance with example implementations, may be electrically charged with a potential that electrically removes remaining ink from the developer roller 220. A sponge roller 240 of the BID assembly 150 may clean the wiper 36, thereby returning residual ink to the ink reservoir.

Figure 4:
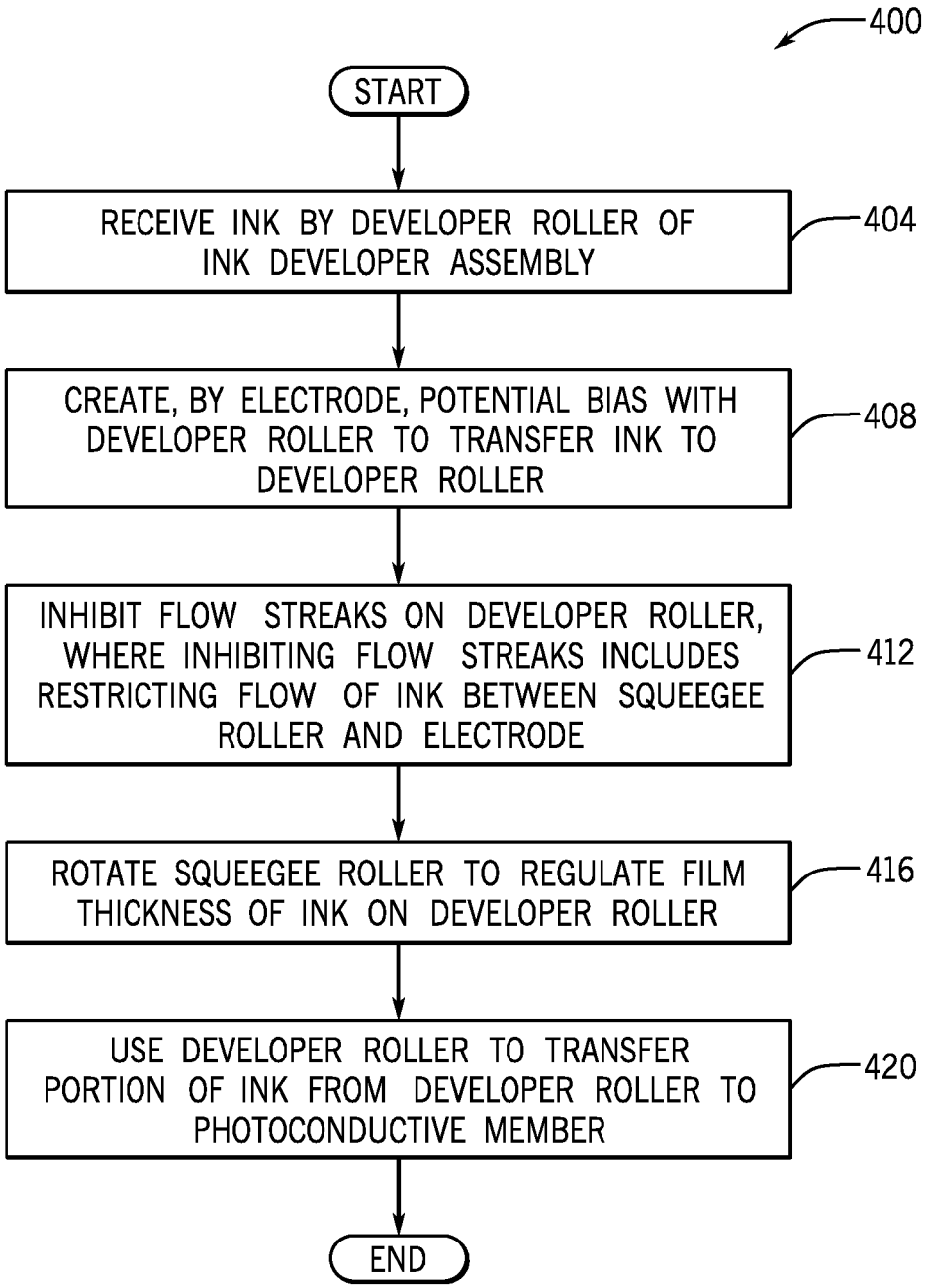
FIG. 4 is a flow diagram depicting a technique to inhibit ink flow streaks from being formed on a developer roller of a BID assembly according to an example implementation.

Referring to FIG. 4, thus, in accordance with example implementations, a technique 400 to inhibit flow streaks in a printing system includes receiving (block 404) ink by a developer roller of an ink developer assembly; and creating (block 408) by an electrode, a potential bias with the developer roller to transfer the ink to the developer roller. The technique includes inhibiting (block 412) flow streaks on the developer roller, where inhibiting the flow streaks includes restricting a flow of ink between a squeegee roller and the electrode. The technique 400 includes rotating (block 416) the squeegee roller to regulate a film thickness of the ink on the developer roller; and using (block 420) the developer roller to transfer a portion of the ink from the developer roller to a photoconductive member.

Figure 5:
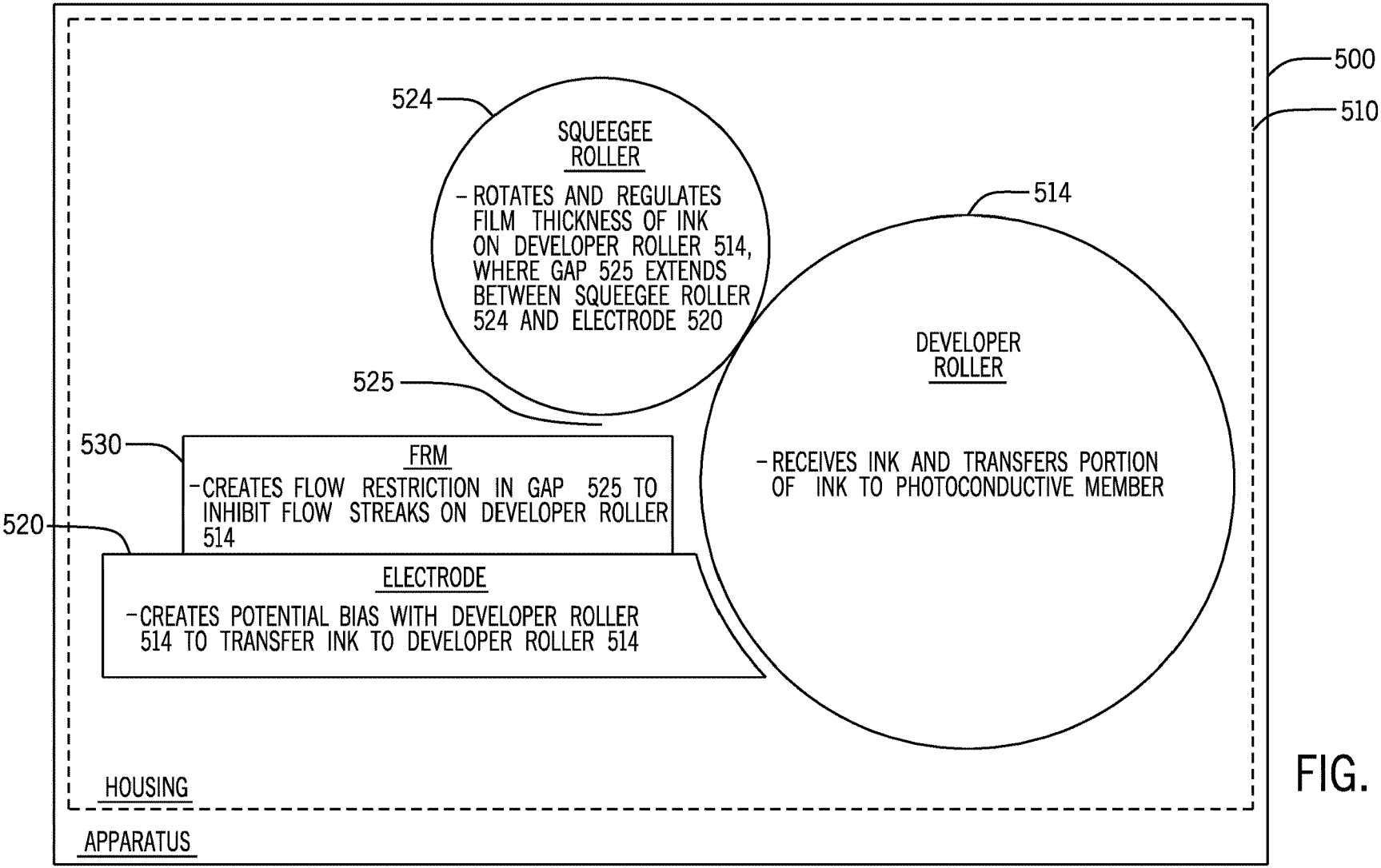
FIG. 5 is a schematic diagram of an apparatus to create a flow restriction in a gap between a squeegee roller and an electrode to inhibit ink flow streaks from forming on a developer roller according to an example implementation.

Referring to FIG. 5, an apparatus 500 includes a housing 510; a developer roller 514; an electrode 520 that is disposed in the housing 510; a squeegee roller 524 that is disposed in the housing 510; and a flow restriction member 530. The developer roller 514 receives ink and transfers a portion of the ink to a photoconductive member; and the electrode 520 creates a potential bias with the developer roller 514 to transfer ink to the developer roller 514. The squeegee roller 524 rotates and regulates a film thickness of ink on the developer roller 514, where an ink flow path 525 extends between the squeegee roller 524 and the electrode 520. The flow restriction member 530 creates a flow restriction in the ink flow path 525 to inhibit ink flow streaks from being formed on the developer roller 514.

Figure 6:
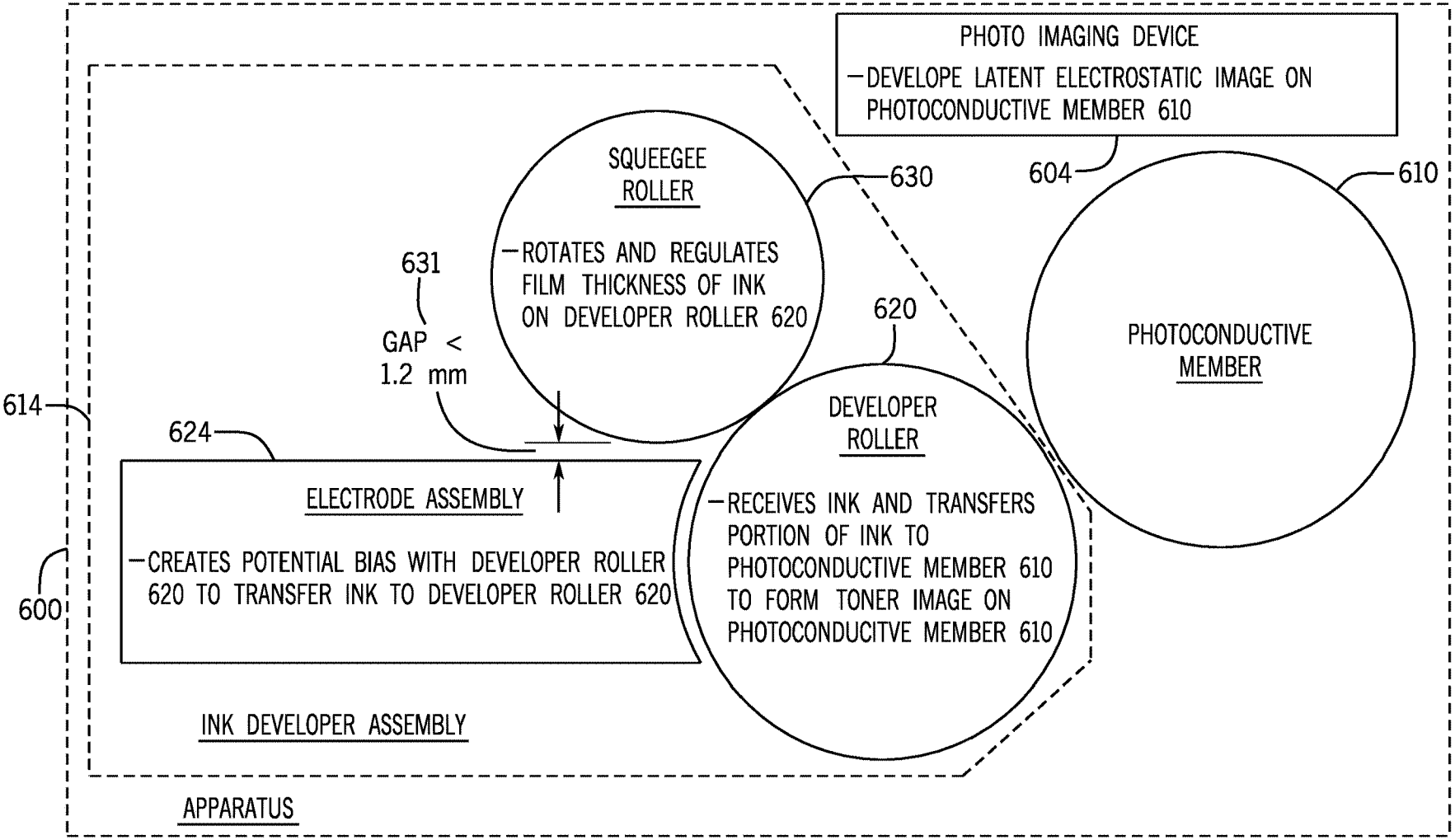
FIG. 6 is a schematic diagram of an apparatus including a BID assembly that includes a gap between a squeegee roller and an electrode of a BID assembly according to an example implementation.

Referring to FIG. 6, in accordance with example implementations, an apparatus 600 includes a photoconductive member 610; a photo imaging device 604; and a binary ink developer assembly 614. The photo imaging device 604 develops a latent electrostatic image on the photoconductive member 610. The binary ink developer 614 ink includes a developer roller 620; an electrode assembly 624; and a gap 631. The developer roller 620 receives ink and transfers a portion of the ink to the photoconductive member 610 to form a toner image on the photoconductive member 610. The electrode assembly 624 creates a potential bias with the developer roller 620 to transfer ink to the developer roller 620. The squeegee roller 630 rotates and regulates a film thickness of ink on the developer roller 620. The gap 631 between the squeegee roller 630 and the electrode assembly 624 is less than 1.2 millimeters (mm).

Figure 7:
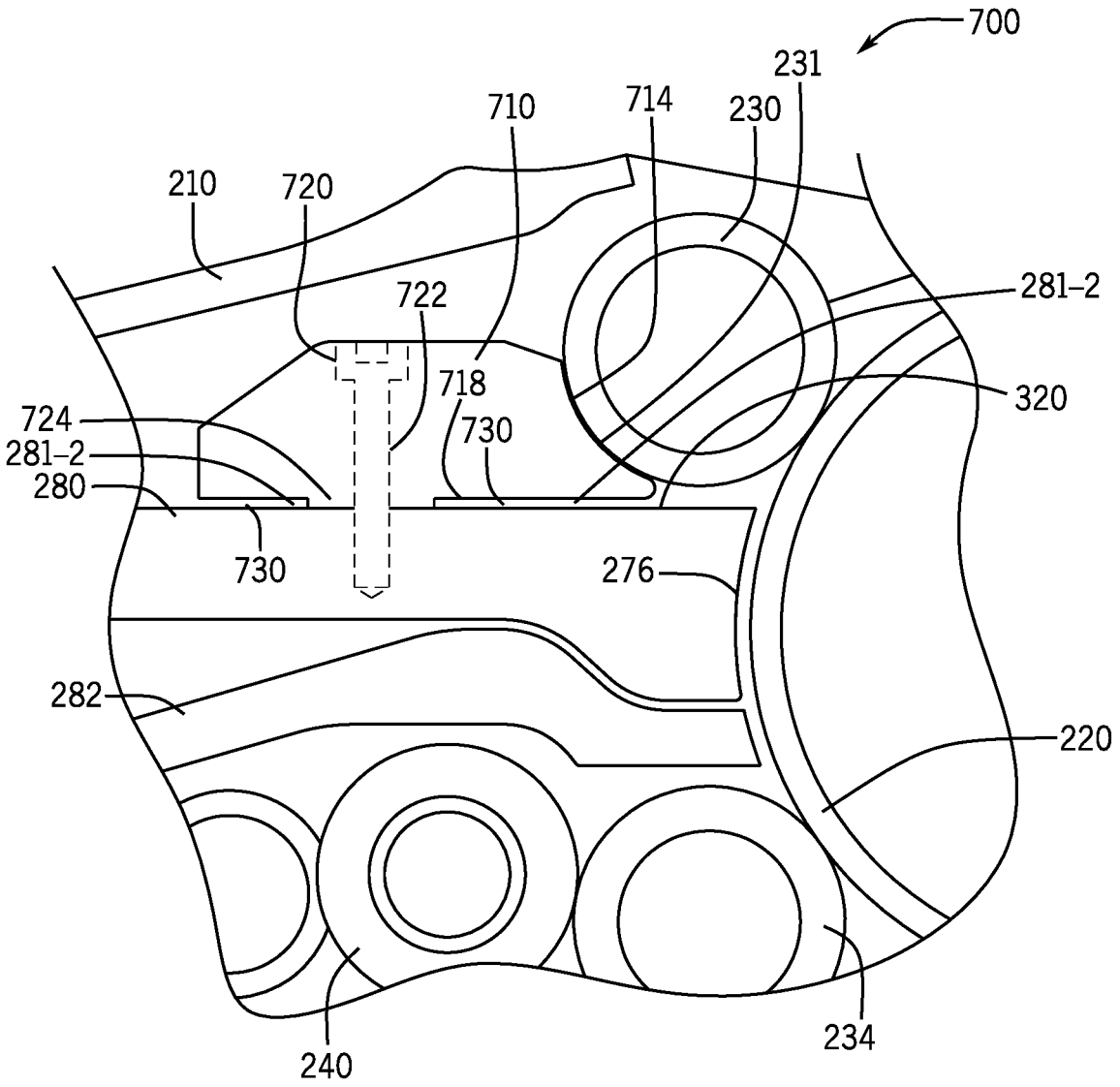
FIG. 7 is a schematic diagram of a portion of a BID assembly illustrating an ink flow restriction formed between an ink splash guard and a main electrode of a BID assembly according to a further example implementation.

Other implementations are contemplated, which are within the scope of the appended claims. For example, in accordance with further example implementations, a dielectric member other than a plastic sheet or plate may be attached to the main electrode 280 for purposes of forming an ink flow restriction. For example, referring to FIG. 7, in accordance with further implementations, a BID assembly (a portion 700 of which is depicted in FIG. 7) may include a splash guard 710 that serves dual functions: 1. the splash guard 710 prevents ink from inadvertently leaving the BID assembly; and 2, the splash guard forms a flow restriction in the ink return channel 281-2. It is noted that the BID assembly depicted in FIG. 7 includes components similar to the components of the BID assembly 150, with these components sharing like reference numerals.

For the BID assembly depicted in FIG. 7, the splash guard 710 replaces the dielectric member 278. The splash guard 710 has a curved surface 714, which conforms, or closely follows, the outer curved surface 231 of the squeegee roller 230. Due to the close gap between the surface 714 and the outer curved surface 231 of the squeegee roller 230, rotation of the squeegee roller 230 forms a viscous pump that creates a pressure to force ink through the ink return channel 281-2.

In accordance with example implementations, the splash guard 710 includes a lower surface 718 (relative to the orientation depicted in FIG. 7), which establishes the flow restriction for the return channel 281-2. More specifically, in accordance with example implementations, one or multiple fasteners 720 extend through corresponding openings 722 of the splash guard 710 to attach, or secure, the splash guard 710 to the main electrode 280. The lower surface 718 of the splash guard 710 includes axial offsets 724. Each axial offset 724 is a protrusion of the lower surface 718 for purposes of establishing a gap 730 between the upper surface 320 of the main electrode 280 and the lower surface 718 of the splash guard 710. In accordance with some implementations, the gap 730 may be in the range of 0.3 to 0.7 mm.

In accordance with further example implementations, an electrically conductive member (in place of the splash guard 710 or dielectric member 278) may be attached to the main electrode to form the ink flow restriction. Moreover, in accordance with further example implementations, the main electrode may be positioned sufficiently close to the outer curved surface of the squeegee roller to create the flow restriction. In accordance with further example implementations, a flow restriction to inhibit ink flow streaks may be formed in a part of the ink flow path other than between the main electrode and the squeegee roller. In this manner, in accordance with further example implementations, the flow restriction may be formed in another part of the ink return channel, may be formed in the ink delivery channel, and so forth.

While the present disclosure has been described with respect to a limited number of implementations, those skilled in the art, having the benefit of this disclosure, will appreciate numerous modifications and variations therefrom. It is intended that the appended claims cover all such modifications and variations

What is claimed is:

1. An apparatus comprising:

a housing;

a developer roller disposed in the housing to receive ink and transfer a portion of the ink to a photoconductive member;

an electrode disposed in the housing to create a potential bias with the developer roller to transfer the ink to the developer roller;

a squeegee roller disposed in the housing to rotate and regulate a film thickness of ink on the developer roller, wherein an ink flow path extends between the squeegee roller and the electrode; and a flow restriction member mounted to the electrode to create a flow restriction in the ink flow path to inhibit ink flow streaks from being formed on the developer roller.

2. The apparatus of claim 1, wherein the flow restriction member comprises a surface that is bonded to a surface of the electrode.

3. The apparatus of claim 1, wherein the flow restriction member forms a gap spanning between the electrode and the squeegee member.

4. The apparatus of claim 3, wherein the gap is in a range of 0.8 millimeters (mm) to 1.2 mm.

5. The apparatus of claim 1, wherein the flow restriction member comprises a planar member.

6. The apparatus of claim 1, wherein the flow restriction member comprises:

a splash guard comprising a first surface to conform to a curved outer surface of the squeegee roller and a second surface to form a gap between the splash guard and the electrode, wherein the ink flow path extends through the gap.

7. The apparatus of claim 6, wherein the splash guard and the squeegee roller form a viscous pump to create a pressure on the ink upstream of the flow restriction.

8. The apparatus of claim 1, further comprising:

a fastener to attach the flow restriction member to the electrode.

9. The apparatus of claim 1, further comprising:

another electrode to transfer the ink to the developer roller, wherein:

the ink flow path comprises a first channel between the electrodes to deliver the ink to the developer roller and a second channel to receive ink not transferred to the developer roller and passed under the squeegee roller; and the flow restriction is formed in the second channel.

10. A method comprising:

receiving ink by a developer roller of an ink developer assembly;

creating, by an electrode, a potential bias with the developer roller to transfer the ink to the developer roller;

inhibiting flow streaks on the developer roller, wherein inhibiting the flow streaks comprises using a flow restriction member mounted to the electrode to restrict a flow of ink between a squeegee roller and the electrode;

rotating the squeegee roller to regulate a film thickness of the ink on the developer roller; and using the developer roller to transfer a portion of the ink from the developer roller to a photoconductive member.

11. The method of claim 10, wherein inhibiting the flow streaks comprises:

creating a flow restriction gap between an outer curved surface of the squeegee roller and the electrode in a range of 0.8 millimeters (mm) to 1.2 mm.

12. The method of claim 10, wherein the flow restriction member comprises a dielectric member and inhibiting the flow streaks comprises mounting the dielectric member to the electrode.

13. An apparatus comprising:

a photoconductive member;

a photo imaging device to form a latent electrostatic image on the photoconductive member; and an ink developer assembly comprising:

a developer roller to receive ink and transfer a portion of the ink to the photoconductive member to form a toner image on the photoconductive member;

an electrode assembly to create a potential bias with the developer roller to transfer ink to the developer roller;

a squeegee roller to rotate and regulate a film thickness of ink on the developer roller; and a gap between the squeegee roller and the electrode assembly less than 1.2 millimeters (mm).

14. The apparatus of claim 13, wherein the electrode assembly comprises:

an electrode; and an electrically nonconductive member attached to the electrode, wherein the gap spans between an outer surface of the electrically nonconductive member and an outer curved surface of the squeegee roller.

15. The apparatus of claim 14, wherein the electrically nonconductive member is bonded to the electrode assembly or attached to the electrode assembly via at least one fastener.

* * * * *